US009151097B1

(12) United States Patent
Elowsky

(10) Patent No.: US 9,151,097 B1
(45) Date of Patent: Oct. 6, 2015

(54) HINGE STOP APPARATUS AND METHOD

(71) Applicant: James Eric Elowsky, Gulf Breeze, FL (US)

(72) Inventor: James Eric Elowsky, Gulf Breeze, FL (US)

( * ) Notice: Subject to any disclaimer, the term of this patent is extended or adjusted under 35 U.S.C. 154(b) by 0 days.

(21) Appl. No.: 14/149,377

(22) Filed: Jan. 7, 2014

(51) Int. Cl.
*E05D 11/06* (2006.01)
*E05D 5/04* (2006.01)
*E05D 5/06* (2006.01)

(52) U.S. Cl.
CPC ..... *E05D 11/06* (2013.01); *E05D 5/04* (2013.01); *E05D 5/06* (2013.01); *Y10T 16/551* (2015.01); *Y10T 16/558* (2015.01); *Y10T 16/5595* (2015.01); *Y10T 16/55963* (2015.01); *Y10T 16/55975* (2015.01); *Y10T 16/55988* (2015.01)

(58) Field of Classification Search
CPC ..... Y10T 16/558–16/55988; Y10T 16/551; Y10T 16/554; Y10T 16/31; E05D 5/04; E05D 5/06; E05D 11/06
USPC ..... 16/387–392, 374, 382, 86.1; D8/323, D8/327–329
See application file for complete search history.

(56) References Cited

U.S. PATENT DOCUMENTS

| | | | | | |
|---|---|---|---|---|---|
| 164,774 | A | * | 6/1875 | Scott | 16/392 |
| D26,381 | S | * | 12/1896 | Chisholm | D8/328 |
| 1,429,527 | A | * | 9/1922 | Paul | 16/389 |
| 1,455,550 | A | * | 5/1923 | Rodell | 16/375 |
| 1,640,525 | A | * | 8/1927 | Belliveau | 16/390 |
| D185,173 | S | * | 5/1959 | Roche | D8/323 |
| D187,262 | S | * | 2/1960 | Anderson | D8/328 |
| RE24,841 | E | * | 6/1960 | Roche | D6/503 |
| 3,016,563 | A | * | 1/1962 | De Jong | 16/320 |
| 3,153,807 | A | * | 10/1964 | Nyman | 16/390 |
| 4,141,110 | A | * | 2/1979 | Wanek | 16/252 |
| 4,873,744 | A | * | 10/1989 | Johnson, Jr. | 16/247 |
| 5,144,721 | A | * | 9/1992 | Schade | 16/237 |
| 5,199,218 | A | * | 4/1993 | McQuade | 49/381 |
| D372,852 | S | * | 8/1996 | Noll et al. | D8/328 |
| 5,839,164 | A | * | 11/1998 | Cress et al. | 16/383 |
| 5,884,363 | A | * | 3/1999 | Tofts | 16/223 |
| 6,170,121 | B1 | * | 1/2001 | Domenig | 16/382 |
| 6,721,995 | B2 | * | 4/2004 | Cress et al. | 16/382 |
| 6,810,563 | B1 | * | 11/2004 | Domenig et al. | 16/387 |
| D557,586 | S | * | 12/2007 | Shire et al. | D8/327 |
| 7,665,187 | B1 | | 2/2010 | Elowsky | |
| D624,387 | S | * | 9/2010 | Charette | D8/323 |
| 7,895,713 | B2 | * | 3/2011 | Williams, Jr. | 16/387 |
| 8,210,504 | B1 | * | 7/2012 | Skornickel | 256/65.01 |
| 8,443,490 | B2 | * | 5/2013 | Forrest et al. | 16/387 |
| 8,739,367 | B2 | * | 6/2014 | Park | 16/389 |
| 2002/0060460 | A1 | * | 5/2002 | DeSouza | 292/238 |
| 2004/0034969 | A1 | * | 2/2004 | Wegman | 16/389 |
| 2004/0231106 | A1 | * | 11/2004 | Shire | 16/390 |
| 2006/0059662 | A1 | * | 3/2006 | Roeper | 16/382 |

(Continued)

FOREIGN PATENT DOCUMENTS

| | | | | | |
|---|---|---|---|---|---|
| GB | 2238345 | A | * | 5/1991 | E05D 5/06 |

*Primary Examiner* — Jeffrey O Brien
(74) *Attorney, Agent, or Firm* — J. Nevin Shaffer, Jr.

(57) ABSTRACT

A hinge stop apparatus and method includes a first hinge connection section and a second hinge connection section. An upper flange section is connected transverse to the first hinge connection section and, also, a lower flange section is connected transverse to the first hinge connection section and spaced apart from the upper flange section. A stop bracket is connected with the first hinge connection section and a hinge device movably connects the first hinge connection section and the second hinge connection section.

16 Claims, 4 Drawing Sheets

(56) References Cited

U.S. PATENT DOCUMENTS

2007/0136999 A1* 6/2007 Huang ..... 16/387
2007/0289094 A1* 12/2007 Lowe et al. ..... 16/238
2011/0088217 A1* 4/2011 Bjorn et al. ..... 16/235
2013/0104345 A1* 5/2013 Granberry ..... 16/374
2013/0219664 A1* 8/2013 Burda ..... 16/374

* cited by examiner

HINGE STOP APPARATUS AND METHOD

CROSS REFERENCE TO RELATED APPLICATION

This application claims the benefit of previously filed U.S. provisional patent application No. 61/848,556 filed Jan. 7, 2013 for a "Universal gate hinge". The Applicant hereby claims the benefit of this provisional application under 35 U.S.C. §119. The entire content of this provisional application is incorporated herein by this reference.

FIELD OF THE INVENTION

This invention relates to a hinge stop apparatus and method. In particular, in accordance with one embodiment, the invention relates to a hinge stop device including a first hinge connection section and a second hinge connection section. An upper flange section is connected transverse to the first hinge connection section and, also, a lower flange section is connected transverse to the first hinge connection section and spaced apart from the upper flange section. A stop bracket is connected with the first hinge connection section and a hinge device movably connects the first hinge connection section and the second hinge connection section.

BACKGROUND OF THE INVENTION

A problem exists with regard to the use of hinges used to support rails between posts. Applicant is knowledgeable of the prior art including Applicant's U.S. Pat. No. 7,665,187 in which the hinge includes opposing flanges that are designed to receive a hinge rail and a gate rail. This design works well for wood gates where the fence rails are attached to the face of the posts. Again, however, when the rails are attached between posts, the hinge rail flanges do not fit easily to the inside of the post. Further, in most single gate construction a latch post provides a satisfactory way of stopping the gate from traveling beyond its limit. However, in double gate construction, the latch post is replaced with a removable drop rod. This method will not prevent the gate from traveling beyond its limit which results, over time, in catastrophic failure of the gate or hinge or both.

Thus, there is a need in the art for a device that enables a hinge to be located on both the inside and outside of a post. Further there is a need for a hinge that prevents undue pressure to be brought to bear on a hinge or hinge post system so as to prevent the failure of either or both.

It therefore is an object of this invention to provide a hinge stop apparatus and method that enables a user to position the hinge on the inside or outside of a post as desired without complicated or expensive machinery. It is a further object to provide a hinge stop device that when located on a post and in a post system prevents undue pressure from being forced upon the hinge thereby preventing hinge and post failure.

SUMMARY OF THE INVENTION

Accordingly, the hinge stop apparatus of the present invention, according to one embodiment, includes a first hinge connection section and a second hinge connection section. An upper flange section is connected transverse to the first hinge connection section and, also, a lower flange section is connected transverse to the first hinge connection section and spaced apart from the upper flange section. A stop bracket is connected with the first hinge connection section and a hinge device movably connects the first hinge connection section and the second hinge connection section.

In one aspect, the first hinge connection section includes a top edge and a bottom edge and side edges and the upper flange section is connected at or near the top edge and the lower flange section is connected at or near the bottom edge and the stop bracket is connected at or near one of the side edges and in-between the upper flange section and the lower flange section.

All terms used herein are given the common meaning. Thus the term "at or near" identifies a location sufficient for the purposes of the invention in that it means that not only an exact location will suffice.

In one aspect, the stop bracket is connected with the first hinge connection section in spaced apart relation from its connection with one of the side edges such that the stop bracket does not overlap the side edge. Here the term "spaced apart relation" describes a connection that includes a separation from the side edge. In one aspect, the stop bracket is spaced apart from its connection with one of the side edges by approximately two inches.

In another aspect, the stop bracket is rectangularly shaped with a long side and a short side and the long side is connected with the first hinge connection section.

In a further aspect, holes are included in at least one of the first hinge connection section, the second hinge connection section and the stop bracket.

In another aspect, the first hinge connection section and the second hinge connection section include cooperating connection knuckles and the stop bracket is connected with the connection knuckles on the first hinge connection section.

In one aspect, the cooperating connection knuckles consist of five connection knuckles where three connection knuckles are on one hinge connection section and two connection knuckles are on the other hinge connection section and the stop bracket is connected to the connection knuckles on one of the hinge connection sections.

In a further aspect, the width of the top edge and bottom edge of the first hinge connection section is greater than the width of the upper flange section and the lower flange section such that a portion of the top edge and the bottom edge is exposed and not connected with the upper flange section and the lower flange section.

According to another embodiment of the invention, a hinge stop apparatus consists of a first hinge connection section with a top edge, a bottom edge and two side edges and a second hinge connection section with a top edge, a bottom edge and two side edges. An upper flange section is connected transverse to the first hinge connection section along at least a portion of the top edge. A lower flange section is connected transverse to the first hinge connection section along at least a portion of the bottom edge and spaced apart from the upper flange section. A stop bracket is connected with the first hinge connection section along one of the two side edges and in between the upper flange section and the lower flange section. A hinge device movably connects the first hinge connection section and the second hinge connection section, the hinge device consisting of interlocking knuckles and a hinge pin.

In one aspect, the stop bracket is connected with the first hinge connection section in spaced apart relation from its connection with one of the side edges such that the stop bracket does not overlap the side edge. In another aspect, the stop bracket is spaced apart from its connection with one of the side edges by approximately two inches. In another aspect, the stop bracket is rectangularly shaped with a long side and a short side and the long side is connected with the first hinge connection section. In one aspect, holes are included in at least one of the first hinge connection section, the second hinge connection section and the stop bracket.

In another aspect, the cooperating connection knuckles consist of five connection knuckles where three connection knuckles are on one hinge connection section and two connection knuckles are on the other hinge connection section and the stop bracket is connected to the connection knuckles on one of the hinge connection sections.

In another aspect, the width of the top edge and bottom edge of the first hinge connection section is greater than the width of the upper flange section and the lower flange section such that a portion of the top edge and the bottom edge is exposed and is not connected with the upper flange section and the lower flange section.

According to another embodiment, a hinge stop method includes the steps of:

a. providing a first hinge connection section with a top edge, a bottom edge and two side edges; a second hinge connection section with a top edge, a bottom edge and two side edges; an upper flange section connected transverse to the first hinge connection section along at least a portion of the top edge; a lower flange section connected transverse to the first hinge connection section along at least a portion of the bottom edge and spaced apart from the upper flange section; a stop bracket connected with the first hinge connection section along one of the two side edges and in between the upper flange section and the lower flange section; and a hinge device movably connecting the first hinge connection section and the second hinge connection section the hinge device consisting of interlocking knuckles and a hinge pin; and b. connecting the second hinge connection section to a post.

In one aspect, the stop bracket is rectangularly shaped with a long side and a short side and the long side is connected with the first hinge connection section.

In another aspect, the stop bracket is connected with the first hinge connection section in spaced apart relation from its connection with one of the side edges such that the stop bracket does not overlap the side edge.

In a further aspect, the width of the top edge and bottom edge of the first hinge connection section is greater than the width of the upper flange section and the lower flange section such that a portion of the top edge and the bottom edge is exposed and not connected with the upper flange section and the lower flange section.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
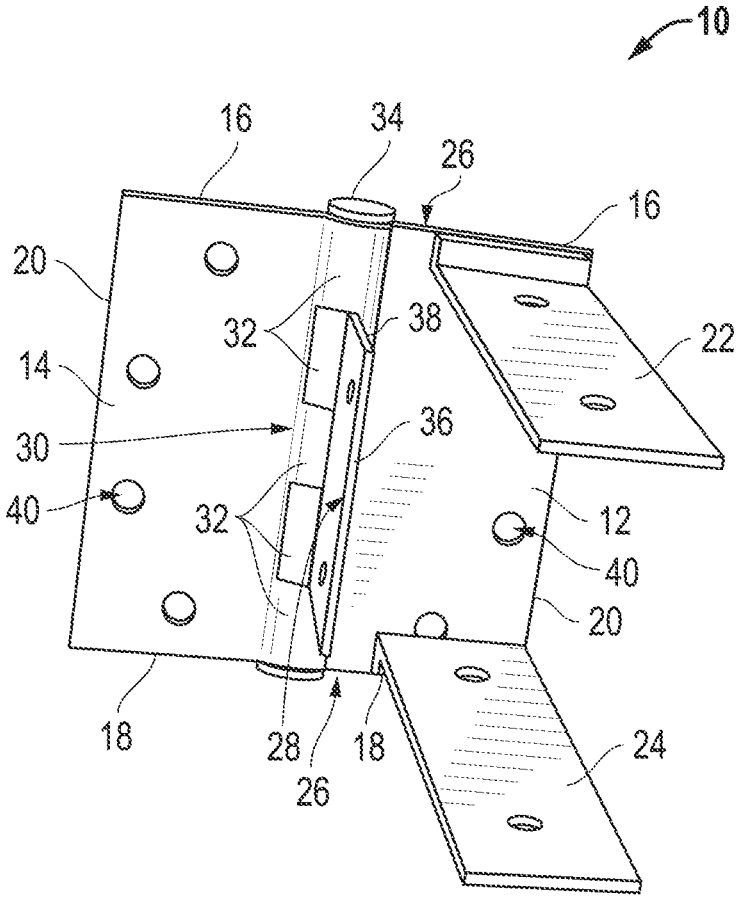
FIG. 1 is a perspective view of the front of the hinge apparatus of the invention.
Figure 2:
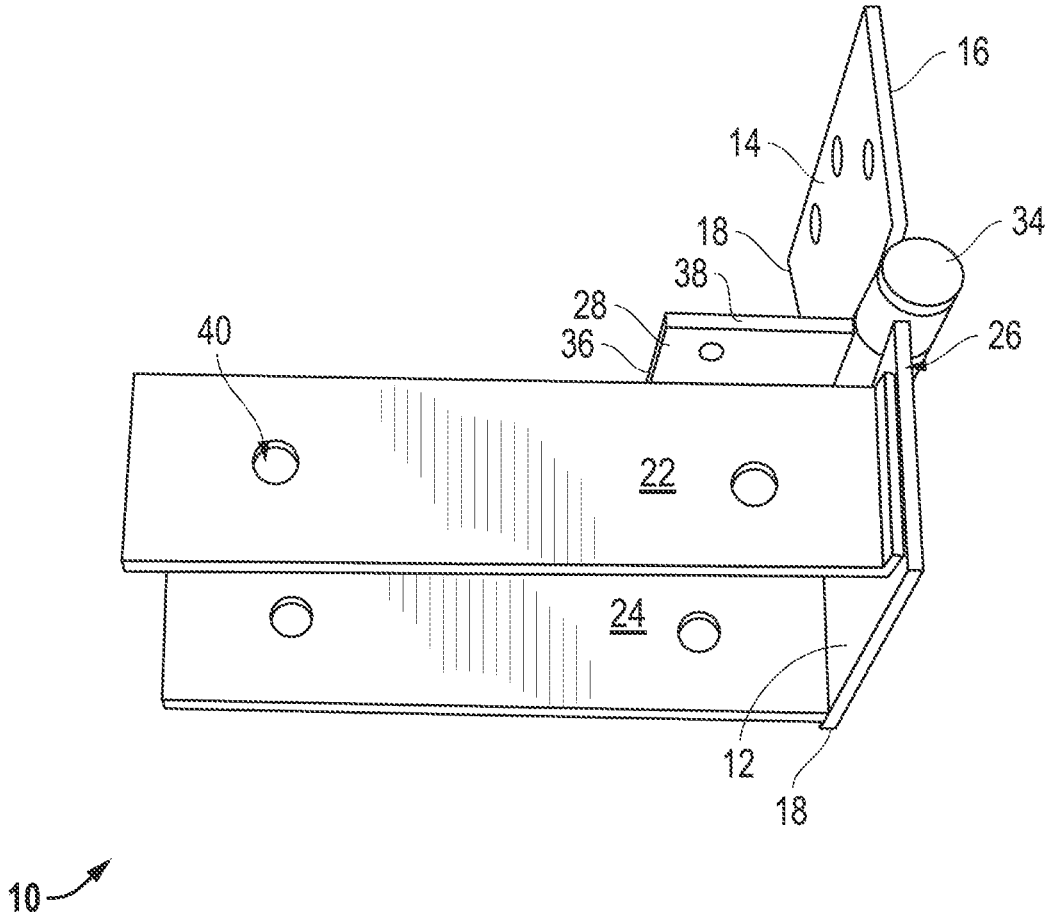
FIG. 2 is a perspective view of the invention of FIG. 1 from the top.

The preferred embodiment of the present invention is illustrated by way of example in FIGS. 1-4. With specific reference to FIGS. 1 and 2, hinge stop apparatus 10 includes a first hinge connection section 12 and a second hinge connection section 14 with a top edge 16, a bottom edge 18 and two sides 20. Upper flange section 22 and lower flange section 24 are connected with first hinge connection section 12 with the upper flange section 22 and lower flange section 24 spaced apart from each other. In a preferred embodiment, upper flange section 22 is connected with first hinge connection section 12 at or near top edge 16 and lower flange section is connected with first hinge connection section 12 at or near bottom edge 18, as illustrated. In a further important embodiment, upper flange section 22 is connected with first hinge connection section 12 at or near top edge 16 and lower flange section is connected with first hinge connection section 12 at or near bottom edge 18 starting at one edge and extending only partially along the top edge 16 and bottom edge 18 as shown. This leaves a portion 26 of top edge 16 and bottom edge 18 open or free or unobstructed by the flanges, again as shown in FIGS. 1 and 2.

Stop bracket 28 is connected with first hinge connection section 12 parallel to one side of first hinge connection section 12 and in between upper flange section 22 and lower flange section 24. Importantly, in a preferred embodiment, stop bracket 28 is connected with first hinge connection section 12 in a spaced apart relation. That is, preferably, stop bracket 28 is not connected directly to the side of first hinge connection 12 and when connected does not overlap the side edge.

In a preferred embodiment, stop bracket 28 is connected to hinge device 30 and hinge device 30 is connected to a side of first hinge connection section 12. Hinge device 30 may be any hinge device for movably connecting the first hinge connection section 12 and the second hinge connection section 14 now known or hereafter developed. The figures illustrate hinge device 30 in the form of a hinge with five knuckles 32 (more clearly shown in FIGS. 3 and 4) with a hinge pin 34. FIGS. 1 and 2 show the preferred embodiment with stop bracket 28 connected with the two hinge knuckles 32 connected with first hinge connection section 12. Because the knuckles 32 extend from first hinge connection section 12, connecting stop bracket, 28 to the knuckles 32 provides the required spaced apart relation with first hinge connection section 12. Applicant has found that a preferred spacing is approximately two inches apart.

Still referring to FIGS. 1 and 2, stop bracket 28 is shown, when desired, in a rectangular shape with a long side 36 and a short side 38. Long side 36 is connected with two knuckles 32, when present, and short side 38 extends outwardly therefrom to create the stop. In this form, the long side 36 of stop bracket 28 is not connected to the knuckle 32 that is in between so that the two hinge connection sections are free to move. Applicant has found that the short side 38 does not need to extend far to provide a good stop in combination with the long side 36. Certainly, stop bracket 28 may be longer and wider as desired.

Holes 40 are shown. Holes 40 provide attachment openings for screws 42 (see FIGS. 3 and 4) and/or nails and the like to use to attach hinge stop apparatus 10 in place. Holes 40 may be formed in all or some of the elements of the invention including first hinge connection section 12, second hinge connection section 14 and stop bracket 28.

Figure 3:
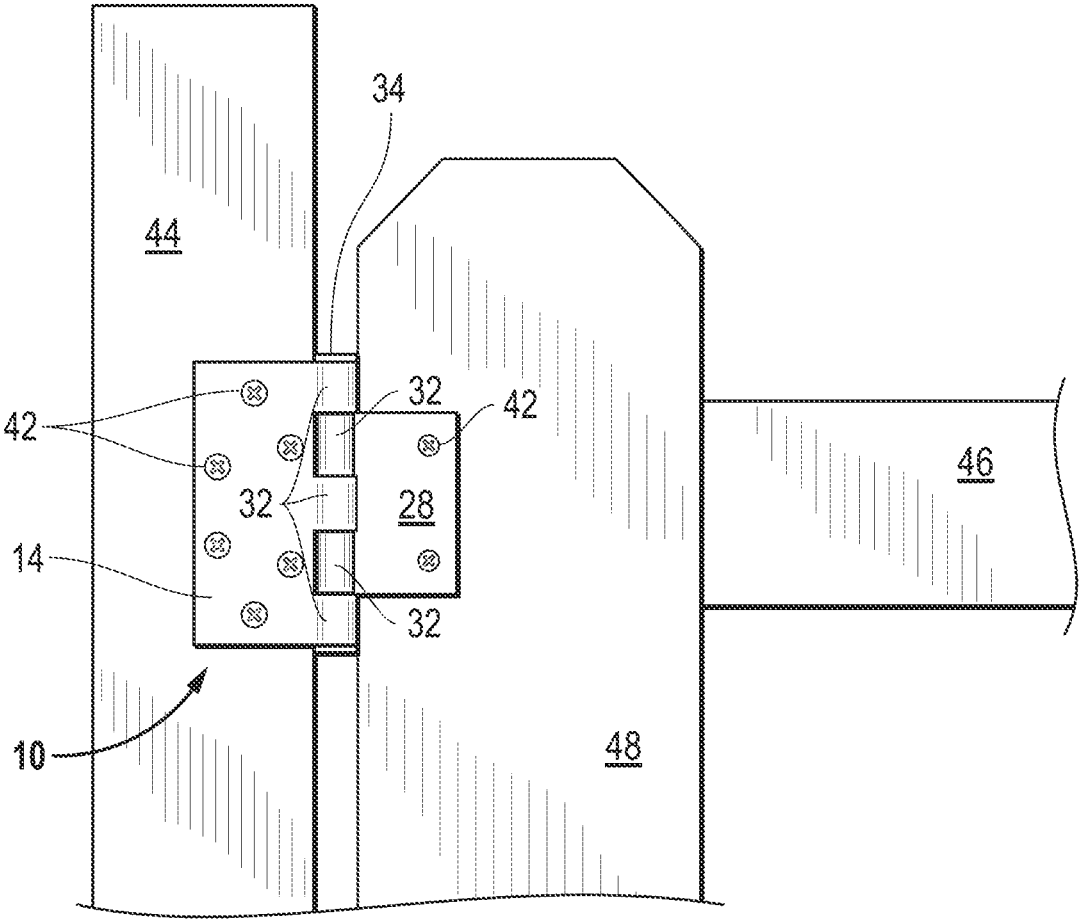
FIG. 3 is a side view of the invention of FIG. 1 showing an outside post attachment configuration with gate rail and fence board attached.

Referring now to FIG. 3, hinge stop apparatus 10 is shown connected on the outside of post 44. Second hinge connection section 14 is secured to post 44 with screws 42 inserted in holes 40. Once secured, gate rail 46 is connected between upper flange section 22 and lower flange section 24 (not shown) and secured in place with screws as well. Thereafter, fence board 48 is secured in place by screws 42 through stop bracket 28 as shown. It may be now more clearly understood that the spaced apart connection of stop bracket 28 and the open portion 26 provide the space necessary to insert fence board 48.

Figure 4:
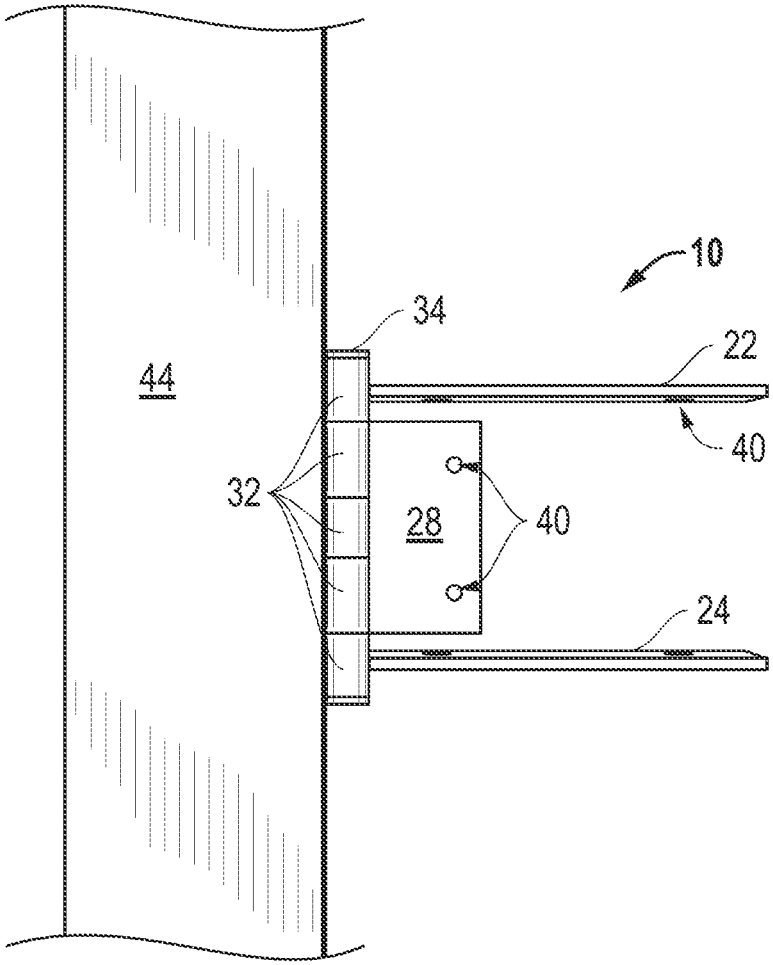
FIG. 4 is a side view of the invention of FIG. 1 showing an inside post attachment.

FIG. 4 shows the unique ability of stop hinge apparatus 10 to connect on the inside of post 44 as well. In this form, second hinge connection section is connected to the inside of post 44 without any loss of function of the device as described herein.

By way of further explanation, Applicant's hinge stop apparatus and method 10 prevents a gate from traveling beyond its limit by transmitting a forced stop to the hinge pin instead of the weakest elements of a fencing system. In the preferred embodiment, the stop bracket 28 is attached about 2⅛ inches from the nearest edge of the first hinge connection section 12. In order to allow room for gate rails 46 at about 1½ inches and fence board at about ⅝ inches. The preferred embodiment places the stop bracket 28 perpendicular to the hinge pin 34 at the midpoint of the hinge knuckles 32 as shown. Applicant has found that placing the stop bracket 28 here prevents damage to the hinge system as described above while also allowing a gate the full range of motion. Certainly, the precise location of the stop bracket 28 can be altered slightly for cosmetic purposes but at the cost, Applicant has found, of some stability.

Hinge stop apparatus and method 10 can be used in a wide variety of applications, literally on any flat surface and importantly, on the inside or outside of a post 44. It may be made by laser cutting or stamping from one piece of metal and may be modified to accept any size lumber or other materials. For example only and not by way of limitation, the hinge stop apparatus and method 10 may be a five knuckle square hinge made from ⅛th inch thick steel, 4½ inches wide by 4½ inches tall. Upper and lower flanges may be made from ⅛th inches thick steel, 1½ inches wide by 5½ inches long and attached by welding. The stop bracket may be made of ⅛th inch thick steel, 1½ inches wide by 3 inches tall also attached by welding. Preferably, upper and lower flanges are spaced 3⅝th inches apart and located relative to the outside edge of the two knuckle side of the first hinge connection section 12 as shown in FIG. 1, for example. Attachment holes 40 may be made where and as needed.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A hinge stop apparatus comprising:

a. a first hinge connection section;

b. a second hinge connection section;

c. an upper flange section connected transverse to said first hinge connection section;

d. a lower flange section connected transverse to said first hinge connection section and spaced apart from said upper flange section;

e. a hinge device movably connecting said first hinge connection section and said second hinge connection section; and f. a stop bracket located between the first hinge connection section and the second hinge connection section at the hinge device;

wherein said first hinge connection section includes a top edge and a bottom edge and side edges and said upper flange section is connected at said top edge and said lower flange section is connected at said bottom edge and said stop bracket is connected at one of said side edges and in-between said upper flange section and said lower flange section;

wherein said first hinge connection section has a width and said upper flange section and said lower flange section have a width and wherein the width of the top edge and bottom edge of said first hinge connection section is greater than the width of said upper flange section and said lower flange section such that a portion of said to edge and said bottom edge is exposed and not connected with said upper flange section and said lower flange section;

wherein a gap is formed between said stop bracket and said upper and lower flange sections for receiving a board;

wherein said stop bracket has a proximal end and a distal end and wherein said proximal end is connected at the hinge device and wherein at least one hole is provided on said distal end of said stop bracket for attaching said distal end to the board.

2. The apparatus of claim 1 wherein said stop bracket is connected with one of said side edges of said first hinge connection section in spaced apart relation such that said stop bracket does not overlap said side edge.

3. The apparatus of claim 2 wherein said stop bracket is spaced apart from one of said side edges by approximately two inches.

4. The apparatus of claim 1 wherein said stop bracket is rectangularly shaped with a long side and a short side and said long side is connected with said first hinge connection section.

5. The apparatus of claim 1 wherein holes are included in said first hinge connection section and said second hinge connection section.

6. The apparatus of claim 1 wherein said first hinge connection section and said second hinge connection section include cooperating connection knuckles and said stop bracket is connected with said cooperating connection knuckles on said first hinge connection section.

7. The apparatus of claim 6 wherein said cooperating connection knuckles consist of five connection knuckles wherein three connection knuckles are on said second hinge connection section and two connection knuckles are on said first hinge connection section.

8. A hinge stop apparatus comprising:

a. a first hinge connection section with a top edge, a bottom edge and a first side edge and a second side edge;

b. a second hinge connection section with a top edge, a bottom edge and a first side edge and a second side edge;

c. an upper flange section connected transverse to said first hinge connection section along at least a portion of said top edge;

d. a lower flange section connected transverse to said first hinge connection section along at least a portion of said bottom edge and spaced apart from said upper flange section;

e. a hinge device movably connecting said first hinge connection section and said second hinge connection section said hinge device consisting of interlocking knuckles and a hinge pin; and f. a stop bracket connected at said hinge device with said first hinge connection section and in between said upper flange section and said lower flange section;

wherein said first hinge connection section has a width and said upper flange section and said lower flange section have a width and wherein the width of the top edge and bottom edge of said first hinge connection section is greater than the width of said upper flange section and said lower flange section such that a portion of said to edge and said bottom edge is exposed and not connected with said upper flange section and said lower flange section;

wherein a gap is formed between said stop bracket and said upper and lower flange sections for receiving a board;

wherein said stop bracket has a proximal end and a distal end and wherein said proximal end is connected at the hinge device and wherein at least one hole is provided on said distal end of said stop bracket for attaching said distal end to the board.

9. The apparatus of claim 8 wherein said stop bracket is connected with said first side edge of said first hinge connection section in spaced apart relation from said first side edge such that said stop bracket does not overlap said first side edge.

10. The apparatus of claim 9 wherein said stop bracket is spaced apart from said first side edge by approximately two inches.

11. The apparatus of claim 8 wherein said stop bracket is rectangularly shaped with a long side and a short side and said long side is connected with said first hinge connection section.

12. The apparatus of claim 8 wherein holes are included in said first hinge connection section and said second hinge connection section.

13. The apparatus of claim 8 wherein said interlocking knuckles consist of five connection knuckles wherein three connection knuckles are on said second hinge connection section and two interlocking knuckles are on said first hinge connection section.

14. A hinge stop method comprising:

a. providing a first hinge connection section with a top edge, a bottom edge and a first side edge and a second side edge; a second hinge connection section with a top edge, a bottom edge and a first side edge and a second side edge; an upper flange section connected transverse to said first hinge connection section along at least a portion of said top edge; a lower flange section connected transverse to said first hinge connection section along at least a portion of said bottom edge and spaced apart from said upper flange section; a hinge device movably connecting said first hinge connection section and said second hinge connection section said hinge device consisting of interlocking knuckles and a hinge pin; and a stop bracket connected at said hinge device and in between said upper flange section and said lower flange section; wherein said first hinge connection section has a width and said upper flange section and said lower flange section have a width and wherein the width of the top edge and bottom edge of said first hinge connection section is greater than the width of said upper flange section and said lower flange section such that a portion of said to edge and said bottom edge is exposed and not connected with said upper flange section and said lower flange section; wherein a gap is formed between said stop bracket and said upper and lower flange sections for receiving a board; wherein said stop bracket has a proximal end and a distal end and wherein said proximal end is connected at the hinge device and wherein at least one hole is provided on said distal end of said stop bracket for attaching said distal end to the board; and b. connecting said second hinge connection section to a post.

15. The method of claim 14 wherein said stop bracket is connected with said first side edge of said first hinge connection section in spaced apart relation from connection with said first side edge such that said stop bracket does not overlap said first side edge.

16. The method of claim 14 wherein holes are included in said first hinge connection section and said second hinge connection section.

* * * * *

UNITED STATES PATENT AND TRADEMARK OFFICE

CERTIFICATE OF CORRECTION

PATENT NO. : 9,151,097 B1
APPLICATION NO. : 14/149377
DATED : October 6, 2015
INVENTOR(S) : James Eric Elowsky It is certified that error appears in the above-identified patent and that said Letters Patent is hereby corrected as shown below:

In the claims

In Column 6, Line 11, “said to” should read --said top--.
In Column 7, Line 03, “said to” should read --said top--.
In Column 8, Line 18, “said to edge” should read --said top edge--.

Signed and Sealed this
Fifth Day of April, 2016

Michelle K. Lee

Michelle K. Lee
*Director of the United States Patent and Trademark Office*